United States Patent [19]

Kokovikhin et al.

[11] 4,305,270

[45] Dec. 15, 1981

[54] HYDROSTATIC PRESSING APPARATUS

[76] Inventors: Evgeny A. Kokovikhin, ulitsa Akademika Bardina, 45, kv. 34; Viktor I. Uralsky, ulitsa Pervomaiskaya, 82, kv. 71, both of Sverdlovsk, U.S.S.R.

[21] Appl. No.: 93,447

[22] Filed: Nov. 13, 1979

[51] Int. Cl.[3] ..... B21D 22/10

[52] U.S. Cl. ..... 72/60; 72/272

[58] Field of Search ..... 72/60, 272, 273, DIG. 31

[56] References Cited

U.S. PATENT DOCUMENTS

| | | | |
|---|---|---|---|
| 2,735,545 | 2/1956 | Norman | 72/272 |
| 3,380,270 | 4/1968 | Sauve | 72/272 X |
| 3,466,915 | 9/1969 | Boshold | 72/272 |
| 3,531,965 | 10/1970 | Nilsson | 72/60 |
| 3,950,979 | 4/1976 | Fuchs, Jr. | 72/60 |
| 4,005,596 | 2/1977 | Ivanovich et al. | 72/60 |

OTHER PUBLICATIONS

Article "Pressing of Metals with High-Pressure Fluids", Moscow, Metallurgia, Publishing House, 1976.

Article "Deformation of Metals with High-Pressure Liquids", Moscow, Metallurgia, Publishing House, 1976.

Article "Hydraulic Pressing of Shaped Profiles", Moscow, Metallurgia, Publishing House, 1978.

*Primary Examiner*—Leon Gilden

*Attorney, Agent, or Firm*—Fleit & Jacobson

[57] ABSTRACT

A hydrostatic pressing apparatus comprising a container having a cavity for accommodation of a blank and communicating with a high pressure source, and a die and a plug which seal the cavity on opposite sides and which are installed in movable locks. The apparatus has a power frame formed by two slabs which are arranged on opposite sides of the container at a distance from one another which is slightly greater than the container length. The die is arranged outside the container and bears with its lock against one of the slabs, and the plug lock bears against the other slab, the cavity of the container being of different diameters along its length, the diameter being the largest on the plug side so as to obtain at the plug a force sufficient for causing the power frame to move to press the die against the container during hydrostatic pressing.

6 Claims, 4 Drawing Figures

HYDROSTATIC PRESSING APPARATUS

The present invention relates to the metal forming equipment, and more specifically, to apparatus for hydrostatic pressing of metals.

The hydrostatic pressing apparatus according to the present invention may be most advantageously used for the manufacture of precise profiled parts of alloyed and difficult to machine grades of steel.

Widely known in the art are apparatus for hydrostatic pressing of metals, comprising a container provided with a cavity for accommodation of a blank. The cavity communicates with a high pressure source by means of a vertical passage of the container.

The cavity of the container accommodates on one side a die and on the opposite side a plug tightly sealing the cavity during hydrostatic pressing.

The die and the plug are mounted in respective locks.

Such apparatus are designed for the hydrostatic pressing of parts of a comparatively small diameter since the die is arranged within the container, and the sizing collar is of a diameter which is limited by the strength requirements imposed on the die.

Also known in the art are apparatus for hydrostatic pressing of metals, comprising a container having a cavity accommodating a blank.

A die is arranged adjacent to the lower end face of the container outside thereof and is pressed against the container by means of a hydraulic drive.

The container cavity on the side opposite to the die communicates with a high pressure source.

Apparatus of such type may be used for the manufacture of parts within a large range of diameters, but the apparatus is relatively complicated since it requires the employment of hydraulic cylinders with the force for pressing the die against the container which is greater than the pressing force.

It is an object of the invention to provide a hydrostatic pressing apparatus which enables the manufacture of parts of comparatively large diameter while being simple in structure.

Further object of the invention is to provide a simple and reliable die seal.

Still another object of the invention is to improve the die strength.

With these and other objects in view, there is provided a hydrostatic pressing apparatus, comprising a container provided with a cavity for accommodation of a blank communicating with a high pressure source, a die and a plug sealing the cavity on opposite sides and installed in movable locks, according to the invention, the apparatus is provided with a power frame formed by two slabs which are arranged on opposite sides of the container at a distance from one another which is slightly greater than the container length and which are interconnected for combined movement, in that the die is arranged outside the container and bears with its lock against one of the slabs, the plug lock bearing against the other slab, the cavity of the container being of varying diameter lengthwise thereof, the diameter being the largest on the plug side so as to provide for a force on the plug during pressing which is sufficient for causing the power frame to move to press the die against the container.

The container cavity is preferably of stepped configuration.

This shape is more convenient for the manufacture and operation.

The slabs are preferably interconnected by means of studs extending through holes of the container.

This interconnection of slabs is simplest from the structural point of view and reliable.

Each slab and respective lock are preferably provided with radial projections which are arranged opposite to one another during hydrostatic pressing.

This coupling of the lock to the slab is comparatively simple in structure and ensures most reliable cooperation of the lock and slab.

Hydraulic cylinders for pressing the die against the container before the pressing begins are preferably installed between the slab against which bears the plug lock and the container, the cylinders being arranged symmetrically with respect to the pressing axis.

An annular hydraulic cylinder for pressing the die against the container before the hydrostatic pressing begins is preferably provided between the slab against which bears the plug lock and the container, the cylinder being arranged symmetrically with respect to the pressing axis.

Preliminary pressing of the die against the container ensures more reliable pressing of die during hydrostatic pressing and facilitates maintenance of the apparatus.

The hydrostatic pressing apparatus according to the invention, while being simple in structure, enables the manufacture of parts of comparatively large diameter, ensures simple and reliable sealing of the die, improves strength and prolongs service life of the die, improves quality of products and productivity of the apparatus and prolongs its service life.

Specific embodiments of the invention will be described in detail with reference to the accompanying drawings, in which.

Figure 1:
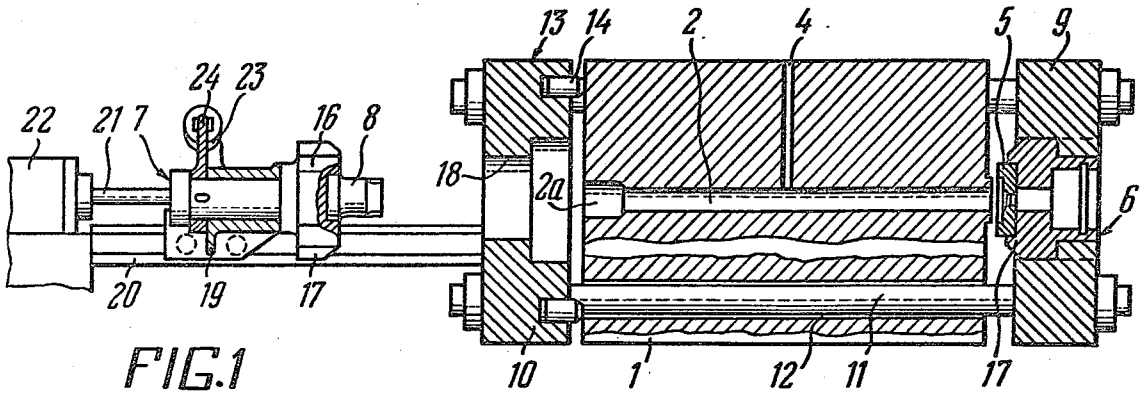
FIG. 1 is a longitudinal section of an apparatus for hydrostatic pressing, partially in section, wherein plug and die are shown in the initial position.
Figure 2:
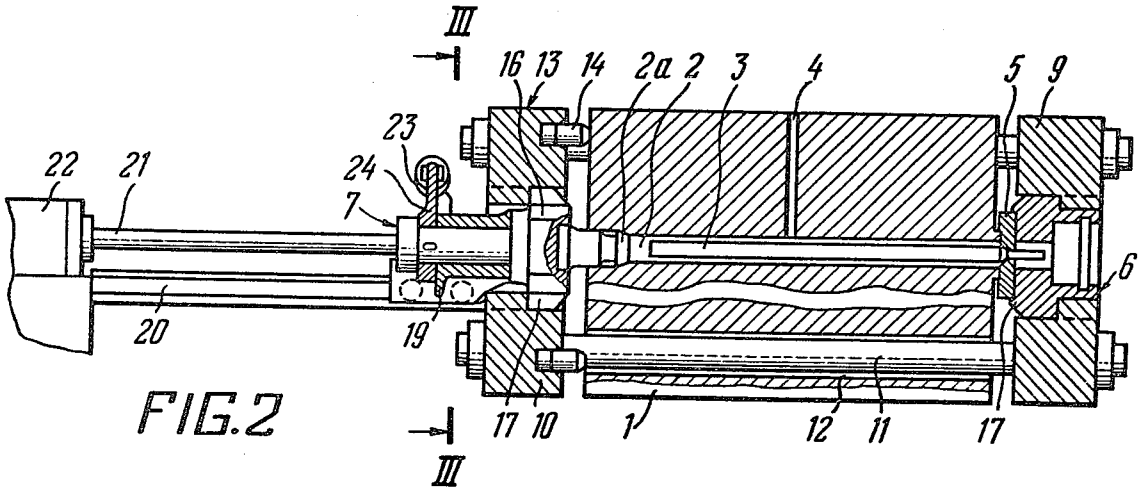
FIG. 2 is the same view with the die and plug shown in the operative position.

A hydrostatic pressing apparatus comprises a container 1 (FIGS. 1,2) having a cavity 2 for accommodation of a blank 3 (FIG. 2). The cavity 2 communicates through a passage 4 with a high pressure source (not shown). A die 5 is arranged outside the container 1 and is installed in a lock 6, and a lock 7 with a plug 8 is arranged on the opposite side of the container 1, the plug 8 having one end thereof received in the cavity 2. The cavity 2 is of stepped configuration with a large diameter step 2*a* on the side of the plug 8.

Figure 3:
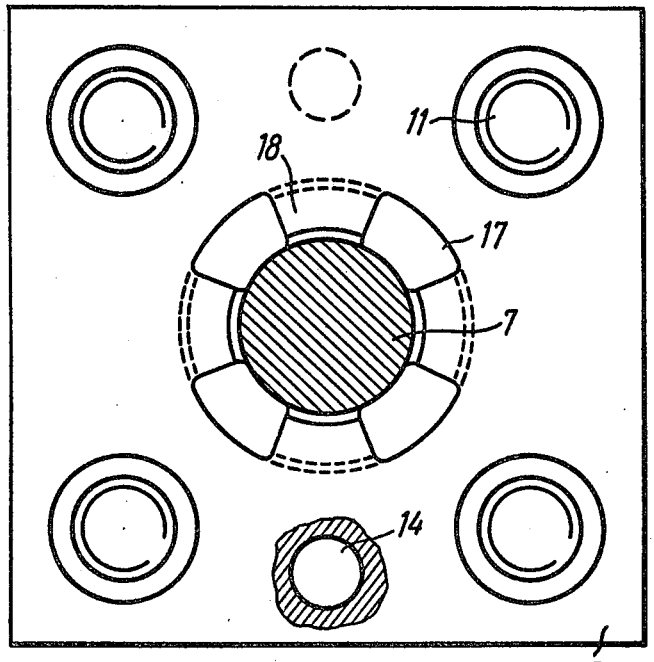
FIG. 3 is an enlarged sectional view taken along the line III—III in FIG. 2.

Slabs 9 and 10 are provided on either side of the container and are interconnected by studs 11 (FIGS. 1 through 3), the studs 11 extending through the container 1, and for that purpose the container has through holes 12. The slabs 9,10 and the studs 11 form a power frame 13.

The lock 6 supporting the die 5 bears against the slab 9. The lock 7 supporting the plug 8 bears against the slab 10.

The slabs 9 and 10 are installed on the studs 11 at a distance from one another which is slightly greater than the length of the container 1.

The plug 8 is received in the cavity 2*a* and enters it over a distance sufficient to ensure permanent sealing during hydrostatic pressing.

For preliminary pressing of the die 5 against the container 1 before the hydrostatic pressing begins, there are provided between the slab 10 and the container 1 two hydraulic cylinders 14 which are arranged symmetrically with respect to the pressing axis.

Figure 4:
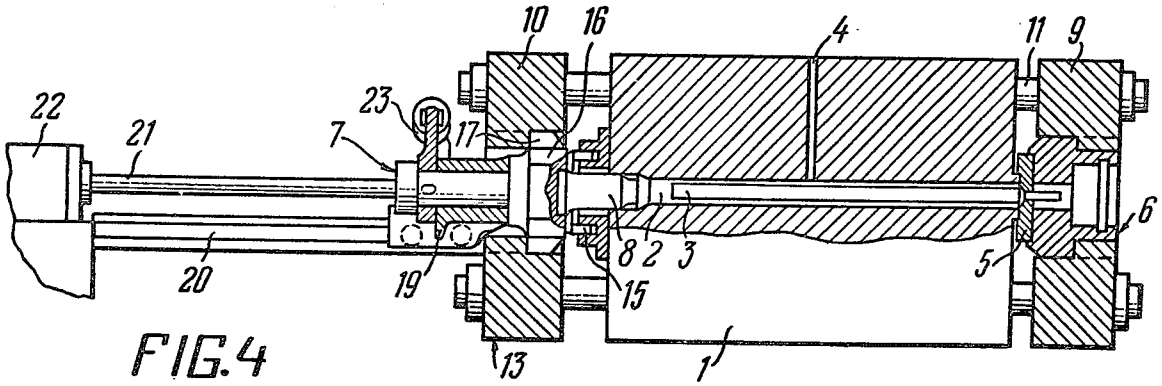
FIG. 4 is a longitudinal section of an apparatus for hydrostatic pressing according to the invention, having an annular hydraulic cylinder for preliminarily pressing the die.

An annular hydraulic cylinder 15 (FIG. 4) may also be used for preliminarily pressing the die 5 against the container 1, the cylinder being arranged symmetrically with respect to the pressing axis.

The lock 7 supporting the plug 8 has at the end thereof adjacent the container 1 a flange 16 having four radial projections 17 equally spaced along the circle of the lock 7.

Similar radial projections 18 (FIGS. 1,3) are provided on the slab 10.

The projections 17 and 18 are in register during hydrostatic pressing so that the lock 7 bears against the slab 10.

For displacing the lock 7 before loading the blank 3 (FIG. 2) into the cavity 2 of the container 1, it is installed on a carriage 19 which is mounted on tracks 20.

The lock 7 is connected to a piston rod 21 of a hydraulic cylinder 22.

For bringing the radial projections 17 and 18 of the lock 7 and slab 10, respectively in register there is provided a hydraulic cylinder 23 having its piston rod connected to the lock 7 by means of a coupling member 24.

The lock 6 of the die 5 has, for bearing against the slab 9 during hydrostatic pressing, the radial projections 17 similar to the projections of the lock 7, and the slab 9 has the radial projections 18 similar to the radial projections of the slab 10.

The lock 6 has a drive (not shown) for causing it to move along the pressing axis and for rotation about this axis similarly to the drive for displacement and rotation of the lock 7 described above. Plugs and dies may be of a different type, but they must be suitable to make the apparatus operative.

Plug and die locks may be of any other appropriate design.

The hydrostatic pressing apparatus functions in the following manner.

Before the beginning of hydrostatic pressing the apparatus is in the position shown in FIG. 1.

The lock 7 with the plug 8 is retracted into the limit lefthand position (in the drawing). The power frame 13 is in the limit righthand position, and the lock 6 is open.

The die 5 having a required cross-sectional shape is installed in the lock 6. The lock 6 is caused to move and rotate in such a manner that the radial projections 17 of the lock 6 can be brought in register with the radial projections 18 of the slab 9. Then the power frame 13 and also the lock 6 and the die 5 are caused to move to the left (in the drawing) by the hydraulic cylinders 14 so that the die 5 is preliminarily pressed against the end face of the container 1.

A blank 3 is loaded into the cavity 2 of the container 1. The lock 7 and the plug 8 are caused to move to the right along the tracks 20 along the pressing axis under the action of the hydraulic cylinder 22, through the piston rod 21, so that the radial projections 17 of the lock 10 extend between the radial projections 18 of the slab 10. The front end portion of the plug 8 is received in the cavity 2*a* thus sealing this cavity.

The hydraulic cylinder 23 coupled by the coupling member 24 to the lock 7 causes the lock 7 to rotate about its axis until the radial projections 17 and 18 are brought in register. Now all members are in the position shown in FIG. 2.

Fluid under high pressure is fed through the passage 4 to the cavity 2 of the container 1. A source of fluid may be a pump (compressor) or a vertical container (not shown) which is secured on the container 1 and has an inner space in which there is a plunger compressing a fluid to create high pressure in the apparatus.

The cavity 2 of the container 1 is of stepped configuration with the larger step 2*a* so that the force acting on the plug 8 on the fluid side is greater than the force of fluid acting on the die 5. The power frame 13 which is coupled to the plug 8 and die 5 by means of the locks 7,6 takes up both these forces and is caused to move to the left under the action of the greater force acting on the plug 8.

Therefore, the die 5 which is pressed against the end face of the container 1 is reliably sealed.

When a pressure required and sufficient for the hydrostatic pressing is achieved, the blank 3 is pressed out through the die 5.

After the pressing is over the lock 7 is opened, a next blank 3 is loaded into the container 1, the lock is closed, and the cycle is repeated.

What is claimed is:

1. A hydrostatic pressing apparatus for pressing a blank along an axis of pressing comprising: a container having a cavity for accommodation of a blank; a high pressure source; the cavity of said container communicating with said high pressure source; a die arranged outside said container on a first side thereof adjacent to one end of said cavity; a plug arranged within the cavity of said container on a side thereof opposite to the position of said die; a lock supporting said die and movable along the pressing axis; a lock supporting said plug and movable along the pressing axis; means for causing said locks of said die and plug to move relative to each other; a power frame formed by two slabs, the slabs being arranged on opposite sides of said container and connected to one another; the cavity of said container being of stepped configuration, with a portion of smaller diameter communicating through a radial channel with said high pressure source, while a portion of larger diameter is blocked by said plug for developing therein during the hydrostatic pressing a force sufficient to move said power frame with respect to said container and to press said die against said container before hydrostatic pressing begins; said two slabs of said power frame being arranged at a distance from one another which is slightly greater than the length of said container; said lock of said die being installed in such a manner that it bears against one of said slabs during the hydrostatic pressing; said lock of said plug being installed in such a manner that it bears against the other of said slabs during pressing.

2. The hydrostatic pressing apparatus according to claim 1, wherein the value of difference between the cross-sectional surface areas of the steps of said container cavity on the side of said plug and said die ranges between 1.15 and 1.25 of the value of the surface area of contact between said die and said container.

3. The hydrostatic pressing apparatus according to claim 1, wherein the slabs are interconnected by means of studs which extend through holes provided in said container.

4. The hydrostatic pressing apparatus according to claim 1, wherein hydraulic cylinders for pressing the die against the container before hydrostatic pressing begins are arranged between the slab on which bears the plug lock and the container.

5. The hydrostatic pressing apparatus according to claim 1, wherein an annular hydraulic cylinder for pressing the die against the container before hydrostatic pressing begins is arranged symmetrically with respect to the pressing axis between the slab against which bears the plug lock and the container.

6. The hydrostatic pressing apparatus according to claim 1, wherein each lock is provided with a cylindrical shank which is mounted on a carrying carriage.

* * * * *